US012742561B2

(12) United States Patent
Nishikawa et al.

(10) Patent No.: US 12,742,561 B2
(45) Date of Patent: Sep. 22, 2026

(54) TEMPERATURE CHAMBER AND ENVIRONMENT FORMING DEVICE

(71) Applicant: ESPEC CORP., Osaka (JP)

(72) Inventors: Taihei Nishikawa, Osaka (JP); Kaori Kikuchi, Osaka (JP)

(73) Assignee: ESPEC CORP., Osaka (JP)

( * ) Notice: Subject to any disclaimer, the term of this patent is extended or adjusted under 35 U.S.C. 154(b) by 378 days.

(21) Appl. No.: 18/444,341

(22) Filed: Feb. 16, 2024

(65) Prior Publication Data

US 2024/0280280 A1 Aug. 22, 2024

(30) Foreign Application Priority Data

Feb. 22, 2023 (JP) ..... 2023-026441

(51) Int. Cl.
*F24F 11/00* (2018.01)
*F24F 7/08* (2006.01)

(52) U.S. Cl.
CPC ..... *F24F 7/08* (2013.01); *F24F 11/0001* (2013.01)

(58) Field of Classification Search
CPC . F24F 7/08; F24F 11/001; H05K 7/20; H05K 7/20009; H05K 7/20545; H05K 7/20554; H05K 7/20718; H05K 2203/1178; H05K 9/0069
USPC ..... 454/284
See application file for complete search history.

(56) References Cited

U.S. PATENT DOCUMENTS

2014/0322525 A1* 10/2014 Legein ..... H01J 37/32541 524/544

FOREIGN PATENT DOCUMENTS

| | | | | |
|---|---|---|---|---|
| CN | 103635065 A | * | 3/2014 | ..... H05K 7/20145 |
| JP | 2006-300864 A | | 11/2006 | |
| JP | 2010230298 A | * | 10/2010 | |
| JP | 2018-151297 A | | 9/2018 | |
| JP | 2021032601 A | * | 3/2021 | |
| KR | 20170005044 A | * | 1/2017 | ..... C08J 5/18 |

OTHER PUBLICATIONS

Imagawa, Kiyomi, KR20170005044 Translation.pdf, "Polymide-film production method", Jan. 2017, pp. 1-119.*
Sakami, Shinichiro, JP2010230298 Translation.pdf, "Supercooling test device and method of supercooling test", Oct. 2010, pp. 1-87.*
(Continued)

*Primary Examiner* — Avinash A Savani
*Assistant Examiner* — Ryan L Faulkner
(74) *Attorney, Agent, or Firm* — Sughrue Mion, PLLC

(57) ABSTRACT

A temperature chamber includes: a first wall and a second wall facing each other; a temperature adjustment space surrounded by a plurality of walls connecting the first wall and the second wall; an air supply port and an exhaust port opening to the temperature adjustment space; and an installation region where a specimen is to be installed in the temperature adjustment space. A main wind orienting member is provided at a position located in the temperature adjustment space and facing the air supply port. A part of blowing air is to pass through a first ventilation passage and to flow into the installation region, and all or a part of the remainder of the blowing air is to be guided to a second ventilation passage by the main wind orienting member and to flow into the installation region.

10 Claims, 14 Drawing Sheets

(56) References Cited

OTHER PUBLICATIONS

Tanaka, Hideki, JP2021032601 Translation.pdf, "Environment test device", Mar. 2021, pp. 1-33.*
Dong, Yuan, CN103635065 Translation.pdf, "Air cooling system and electronic device", Mar. 2014, pp. 1-55.*

* cited by examiner

TEMPERATURE CHAMBER AND ENVIRONMENT FORMING DEVICE

CROSS-REFERENCE TO RELATED APPLICATIONS

The present application is based on Japanese Patent Application No. 2023-026441 filed on Feb. 22, 2023, the contents of which are incorporated herein by reference.

TECHNICAL FIELD

The present invention relates to a temperature chamber in which a specimen such as an object to be tested or an object to be treated can be placed under a specific environment.

BACKGROUND

Electronic devices such as personal computers, mobile terminals, and car navigation devices are in widespread use. These electronic devices may be exposed to high-temperature environments. Conversely, the electronic devices may also be exposed to low-temperature environments.

For this reason, there is a demand to test influences of the temperature environments on the electronic devices and components thereof.

Temperature chambers used for these purposes include an entire temperature adjustment-type device that has a large volume and adjusts a temperature of the entire inside to a constant temperature, and a spot-type device that blows air directly or indirectly a specimen placed in a space with a relatively small volume.

An environmental testing device disclosed in Patent Literature 1 is a device that can be referred to as a spot-type device.

The environmental testing device disclosed in Patent Literature 1 is an environmental testing device that evaluates performance of an electronic device in a temperature environment, includes a box body in which a circuit board is arranged, and supplies air adjusted to a predetermined temperature by a heat exchanger into the box body.

The environmental testing device disclosed in Patent Literature 1 has an X-Y table, and blows air directly to a semiconductor device mounted on the circuit board. When a test for one semiconductor device is completed, the X-Y table is driven to move the circuit board and air is blown directly to another semiconductor device.

Patent Literature 1: JP2006-300864A

The spot-type temperature chamber has an advantage of having a small external shape. On the other hand, the spot-type temperature chamber has a problem that it is sometimes difficult to make the temperature of the specimen uniform, and therefore, temperature unevenness is likely to occur in the specimen. It can be said that the environmental testing device disclosed in Patent Literature 1 is an invention based on the premise that temperature unevenness occurs in the specimen.

The present invention has been made in view of the aforementioned problems of the related art, and an object thereof is to provide a temperature chamber and an environment forming device in which temperature unevenness is unlikely to occur in a specimen.

SUMMARY

An aspect of the present invention is a temperature chamber including: a first wall and a second wall facing each other; a temperature adjustment space surrounded by a plurality of walls connecting the first wall and the second wall; an air supply port and an exhaust port opening to the temperature adjustment space; and an installation region where a specimen is to be installed in the temperature adjustment space. The plurality of walls include an air supply wall formed with the air supply port and a plurality of side walls connected to the air supply wall. A main wind orienting member that overlaps with at least a part of the air supply port when the air supply port is seen from a front, is provided at a position located in the temperature adjustment space and facing the air supply port. A first ventilation passage is provided at, at least one of a position between the main wind orienting member and the first wall and a position between the main wind orienting member and the second wall. A second ventilation passage is provided on a side of the side wall with respect to the main wind orienting member. A part of blowing air introduced from the air supply port is to pass through the first ventilation passage and to flow into the installation region, and all or a part of the remainder of the blowing air introduced from the air supply port is to be guided to the second ventilation passage by the main wind orienting member and to flow into the installation region.

In the above aspect, the main wind orienting member preferably overlaps with only the part of the air supply port when the air supply port is seen from the front.

In the above aspect, the main wind orienting member preferably has a wind guide surface configured to guide the blowing air to the second ventilation passage.

In the above aspect, an auxiliary wind orienting member configured to guide the blowing air toward the side of the side wall is preferably provided in a vicinity of the main wind orienting member.

In the above aspect, the auxiliary wind orienting member is preferably provided on each of both sides of the main wind orienting member.

In the above aspect, the second ventilation passage is preferably configured at a position between the main wind orienting member and the auxiliary wind orienting member.

In the above aspect, a height of the auxiliary wind orienting member is preferably higher than a height of the main wind orienting member.

In the above aspect, an observation window is preferably provided.

In the above aspect, at least one corner portion of the temperature adjustment space is preferably a curved surface or an inclined surface.

In an aspect related to an environment forming device, the environment forming device includes any one of the aforementioned temperature chambers and a gas supply portion configured to supply a temperature-adjusted gas. The environment forming device is configured to adjust an environment in the temperature adjustment space by supplying the gas from the gas supply portion to the temperature chamber.

DESCRIPTION OF EMBODIMENTS

Hereinafter, embodiments of the present invention will be described.

An environment forming device 1 of the present embodiment is used as an environmental testing device.

Figure 1:
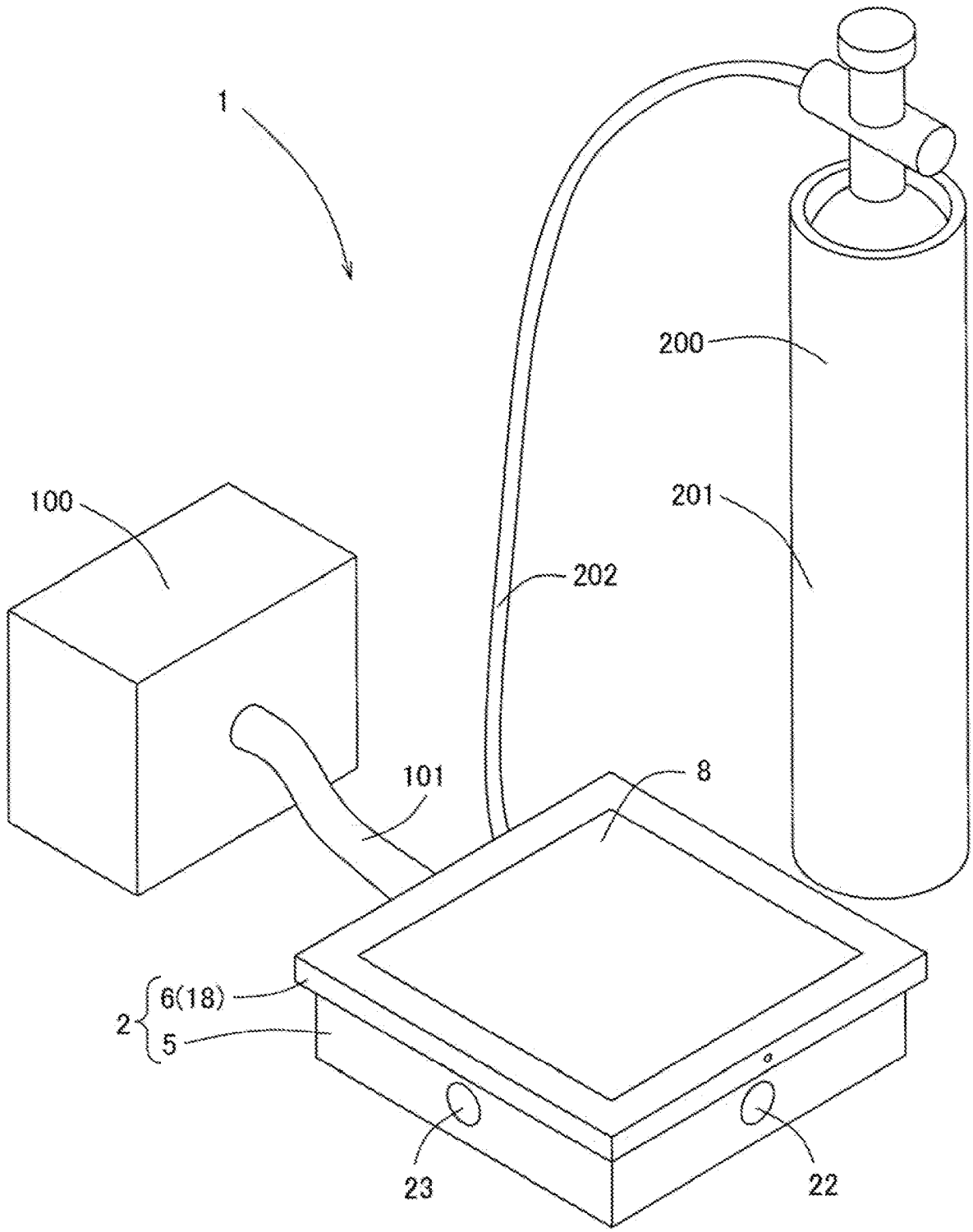
FIG. 1 is a perspective view of an environment forming device according to an embodiment of the present invention.

As shown in FIG. 1, the environment forming device 1 includes an air conditioning portion (gas supply portion) 100, a dry gas supply portion 200, and a temperature chamber 2.

The air conditioning portion (gas supply portion) 100 has a built-in air conditioning device (not shown), and supplies air adjusted to a desired temperature to the temperature chamber 2. Note that the air conditioning portion (gas supply portion) 100 may adjust humidity, in addition to temperature.

The air conditioning portion 100 employed in the present embodiment includes a cooler and a heater as the air conditioning device, and can discharge air adjusted to an arbitrary temperature. That is, the air conditioning portion can supply, to the temperature chamber 2, air adjusted over a wide temperature range from a low temperature of several tens of degrees below a freezing point to a high temperature of hundreds of degrees Celsius.

The dry gas supply portion 200 is configured by a nitrogen cylinder 201, a pressure reducing valve (not shown), and the like, and supplies gas with a low dew point. The dry gas supply portion 200 may use air as a raw material, and may perform processing of reducing a water vapor content of the air.

Next, the temperature chamber 2 will be described.

An external appearance of the temperature chamber 2 is a rectangular parallelepiped with a substantially square planar shape and a low height, as shown in FIG. 1. The temperature chamber 2 is configured by a main body part 5 and a cover body 6.

Figure 2:
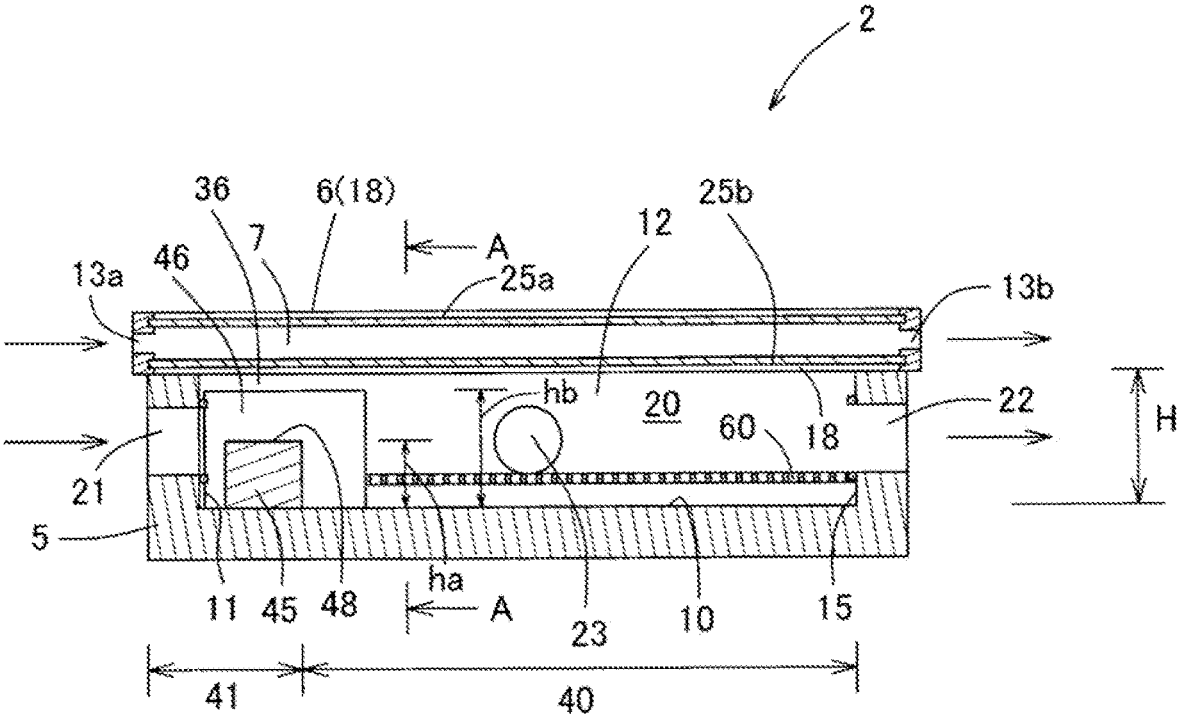
FIG. 2 is a cross-sectional view of a temperature chamber of the environment forming device in FIG. 1.
Figure 5:
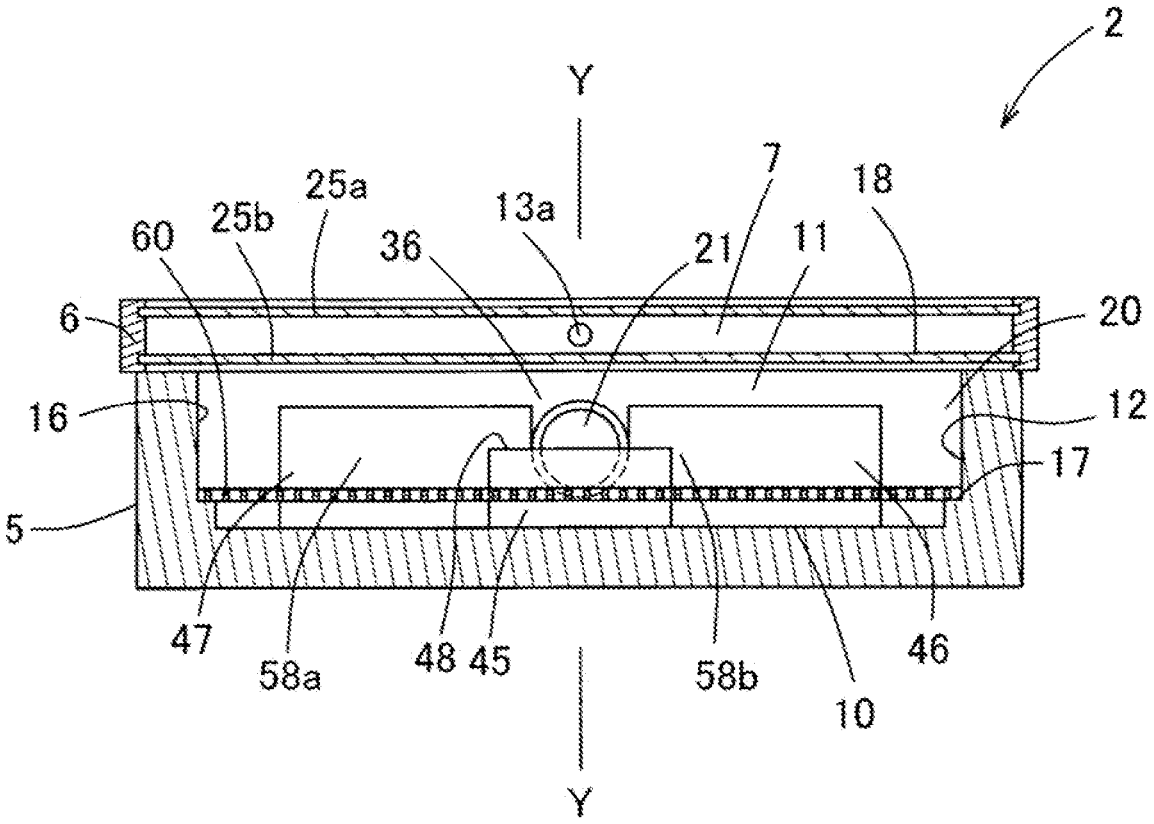
FIG. 5 is a cross-sectional view taken along a line A-A of FIG. 2, showing an air supply port seen from an installation region side.

The cover body 6 is a member having a large observation window 8. That is, the cover body 6 is a rectangular parallelepiped with a substantially square planar shape and a flat shape, and an observation window 8 is provided on main surface thereof (a surface with the largest area). Glass plates 25*a* and 25*b* are inset to the observation window 8, as shown in FIGS. 2 and 5. The glass plates 25*a* and 25*b* are transparent and heat resistant.

There is a gap 7 between the glass plates 25*a* and 25*b*. A side surface of the cover body 6 is provided with holes 13*a* and 13*b* that communicate the gap 7 with the outside.

The cover body 6 covers an opening of the main body part 5, and in the present embodiment, the cover body 6 functions as a first wall 18.

The main body part 5 is a box-shaped member covered with an insulating material and having an open upper surface.

That is, the main body part 5 has a second wall 10 that covers the bottom, and four walls 11, 12, 15, and 16 that cover the surrounding.

When the opening of the main body part 5 is closed with the cover body 6, a space is formed therein which is surrounded by the cover body 6 as a first wall 18, a second wall (bottom wall) 10 facing the first wall 18, and four walls 11, 12, 15, and 16 connecting the first wall 18 and the second wall 10. In the below, the space surrounded by the first wall 18 and the second wall 10 facing each other, and the four walls 11, 12, 15, and 16 connecting both the walls is referred to as a temperature adjustment space 20.

In the present embodiment, an air supply port 21 is provided in one of the walls. In the below, the wall 11 provided with the air supply port 21 is referred to as an air supply wall 11. In addition, an exhaust port 22 is provided in the wall 15 facing the air supply wall 11. In the below, the wall 15 provided with the exhaust port 22 is referred to as an exhaust wall 15.

When the configuration of the temperature chamber 2 is described differently by changing the names of the walls, the temperature chamber 2 of the present embodiment has a temperature adjustment space 20 surrounded by a first wall 18 and a second wall 10 facing each other, and the four walls 11, 12, 15, and 16 connecting the first wall 18 and the second wall 10. One of the four walls 11, 12, 15, and 16 is the air supply wall 11 formed with the air supply port 21, and another wall 15 is the exhaust wall 15 provided with the exhaust port 22. The air supply port 21 slightly protrudes from the air supply wall 11 toward the temperature adjustment space 20 side.

The remaining two walls 12 and 16 are side walls 12 and 16 connected to the air supply wall 11. On inner surface sides of the side walls 12 and 16, stepped portions 17 are provided as shown in FIG. 5. In addition, the side walls 12 and 16 are provided with through-holes 23. The through-hole 23 is provided to pass a signal line or the like therethrough.

In the present embodiment, corner portions of the temperature adjustment space 20 are configured as curved surfaces. That is, a first corner portion 30 serving as a connection surface of the air supply wall 11 and the side wall 12, a second corner portion 31 serving as a connection surface of the side wall 12 and the exhaust wall 15, a third corner portion 32 serving as a connection surface of the exhaust wall 15 and the side wall 16, and a fourth corner portion 33 serving as a connection surface of the side wall 16 and the air supply wall 11 are all arc surfaces.

The temperature chamber 2 of the present embodiment has an installation region 40 for installing a specimen 300 in the temperature adjustment space 20. In the temperature chamber 2 of the present embodiment, a wind orienting member arrangement region 41 is formed between the air supply wall 11 and the installation region 40, and a main wind orienting member 45 and auxiliary wind orienting members 46 and 47 are installed therein.

The main wind orienting member 45 and the auxiliary wind orienting members 46 and 47 employed in the present embodiment are all triangular prism shapes. That is, the main wind orienting member 45 has an isosceles triangle in a planar shape. More specifically, the planar shape of the main wind orienting member 45 is a right-angled isosceles triangle with a base 50 and two oblique sides 51, and the two oblique sides 51 are in contact with each other by an apex angle portion 52 of 90 degrees. Side surfaces 81 and 82 (refer to FIG. 7A) of the triangular prism including the two oblique sides 51 serve as wind guide surfaces that guide blowing air to the side walls 12 and 16 sides of the temperature chamber 2.

Figure 7A:
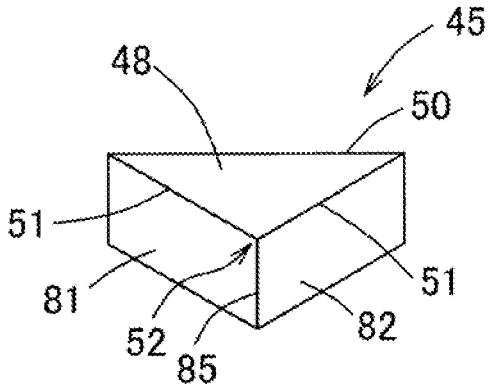
FIG. 7A is a perspective view of a main wind orienting member observed from a different direction.
Figure 7B:
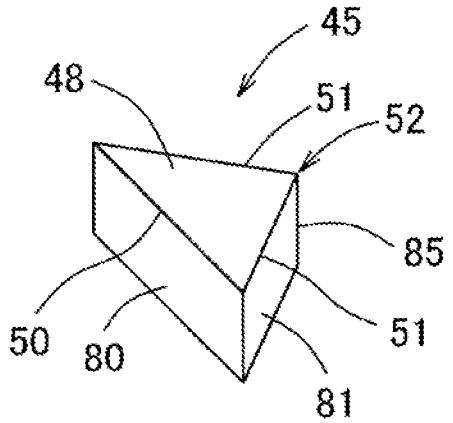
FIG. 7B is a perspective view of the main wind orienting member observed from a different direction.

In the below, the shape of the main wind orienting member 45 will be described. FIGS. 7A and 7B are perspective views of the main wind orienting member 45 alone. The main wind orienting member 45 is a triangular prism as shown in FIGS. 7A and 7B, and is a block-shaped member surrounded by a top surface 48, a bottom surface, and three side surfaces 80, 81, and 82 connecting the top surface 48 and the bottom surface.

The top surface 48 of the main wind orienting member 45 has a base 50 and two oblique sides 51, and the two oblique sides 51 of the top surface 48 are in contact with each other by an apex angle portion 52 of 90 degrees.

The side surface 80 of the main wind orienting member 45 is a surface hanging down from the base 50 of the top surface 48. The side surface 81 (wind guide surface) of the main wind orienting member 45 is a surface hanging down from the oblique side 51 of the top surface 48. The side surface 82 (wind guide surface) of the main wind orienting member 45 is a surface hanging down from the other oblique side 51 of the top surface 48.

The two side surfaces (wind guide surfaces) 81 and 82 are connected by a straight line 85. The straight line 85 is a straight line hanging down from the apex angle portion 52 of the top surface 48.

The top surface 48 of the main wind orienting member 45 is a flat surface.

A height ha of the main wind orienting member 45 is considerably lower than a height H of the temperature adjustment space 20, as shown in FIG. 2.

The planar shapes of the auxiliary wind orienting members 46 and 47 are also an isosceles triangle, respectively.

Figure 8A:
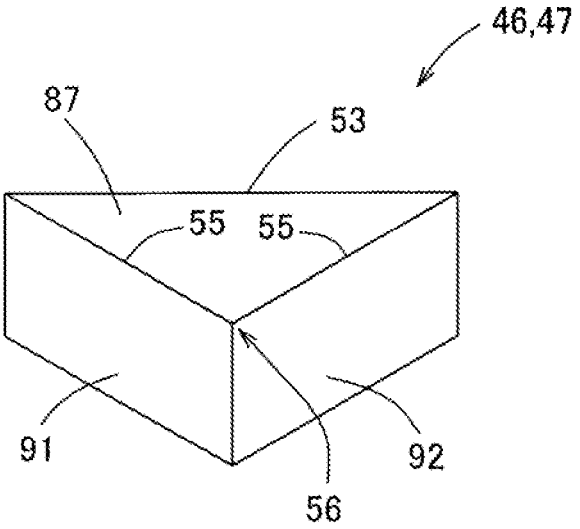
FIG. 8A is a perspective view of an auxiliary wind orienting member observed from a different direction.
Figure 8B:
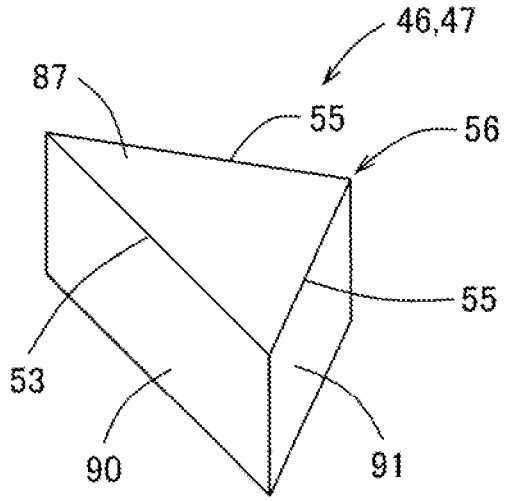
FIG. 8B is a perspective view of the auxiliary wind orienting member observed from a different direction.

In the below, the shapes of the auxiliary wind orienting members 46 and 47 will be described. FIGS. 8A and 8B are perspective views of the auxiliary wind orienting members 46 and 47 alone. The auxiliary wind orienting members 46 and 47 are triangular prisms as shown in FIGS. 8A and 8B, and are each a block-shaped member surrounded by a top surface 87, a bottom surface, and three side surfaces 90, 91, and 92 connecting the top surface 87 and the bottom surface.

The top surface 87 of each of the auxiliary wind orienting members 46 and 47 has a base 53 and two oblique sides 55, and the two oblique sides 55 of the top surface 87 are in contact with each other by an apex angle portion 56 of 90 degrees.

The side surface 90 of each of the auxiliary wind orienting members 46 and 47 is a surface hanging down from the base 53 of the top surface 87. The side surface 91 of each of the auxiliary wind orienting members 46 and 47 is a surface hanging down from the oblique side 55 of the top surface 87. The side surface 92 of each of the auxiliary wind orienting members 46 and 47 is a surface hanging down from the other oblique side 55 of the top surface 87.

The top surface 87 of each of the auxiliary wind orienting members 46 and 47 is a flat surface.

When comparing sizes of the main wind orienting member 45 and the auxiliary wind orienting members 46 and 47, the main wind orienting member 45 is smaller than the auxiliary wind orienting members 46 and 47. That is, a planar area of the main wind orienting member 45 is smaller than a planar area of each of the auxiliary wind orienting members 46 and 47. Additionally, the height ha of the main wind orienting member 45 is lower than heights hb of the auxiliary wind orienting members 46 and 47.

Between the top surface 48 of the main wind orienting member 45 and the first wall 18, there is a gap that serves as a first ventilation passage 36, as shown in FIGS. 2 and 5.

Next, an arrangement layout of the main wind orienting member 45 and the auxiliary wind orienting members 46 and 47 will be described.

Figure 3:
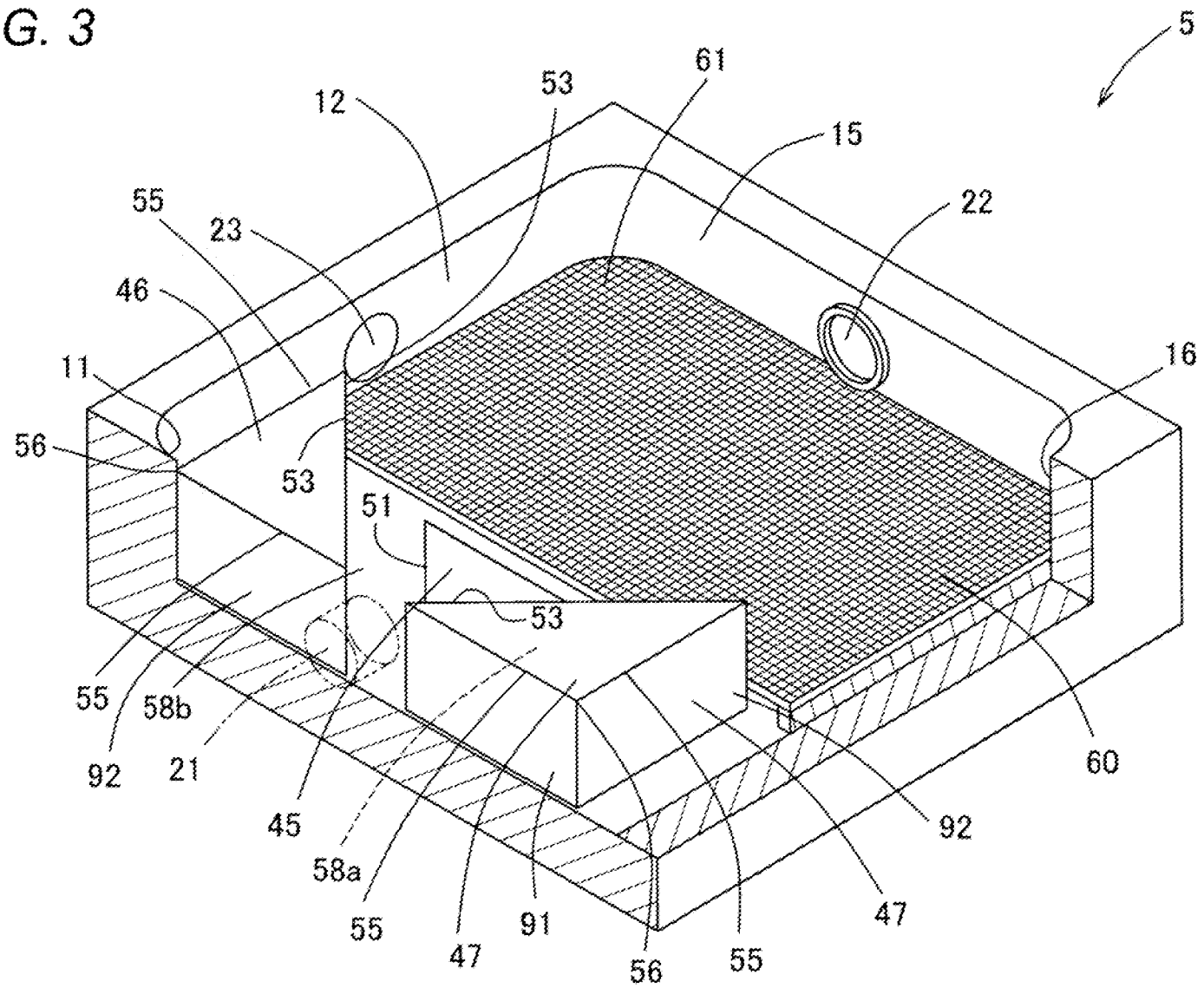
FIG. 3 is a sectional perspective view of a main body part of the temperature chamber in FIG. 2.
Figure 4:
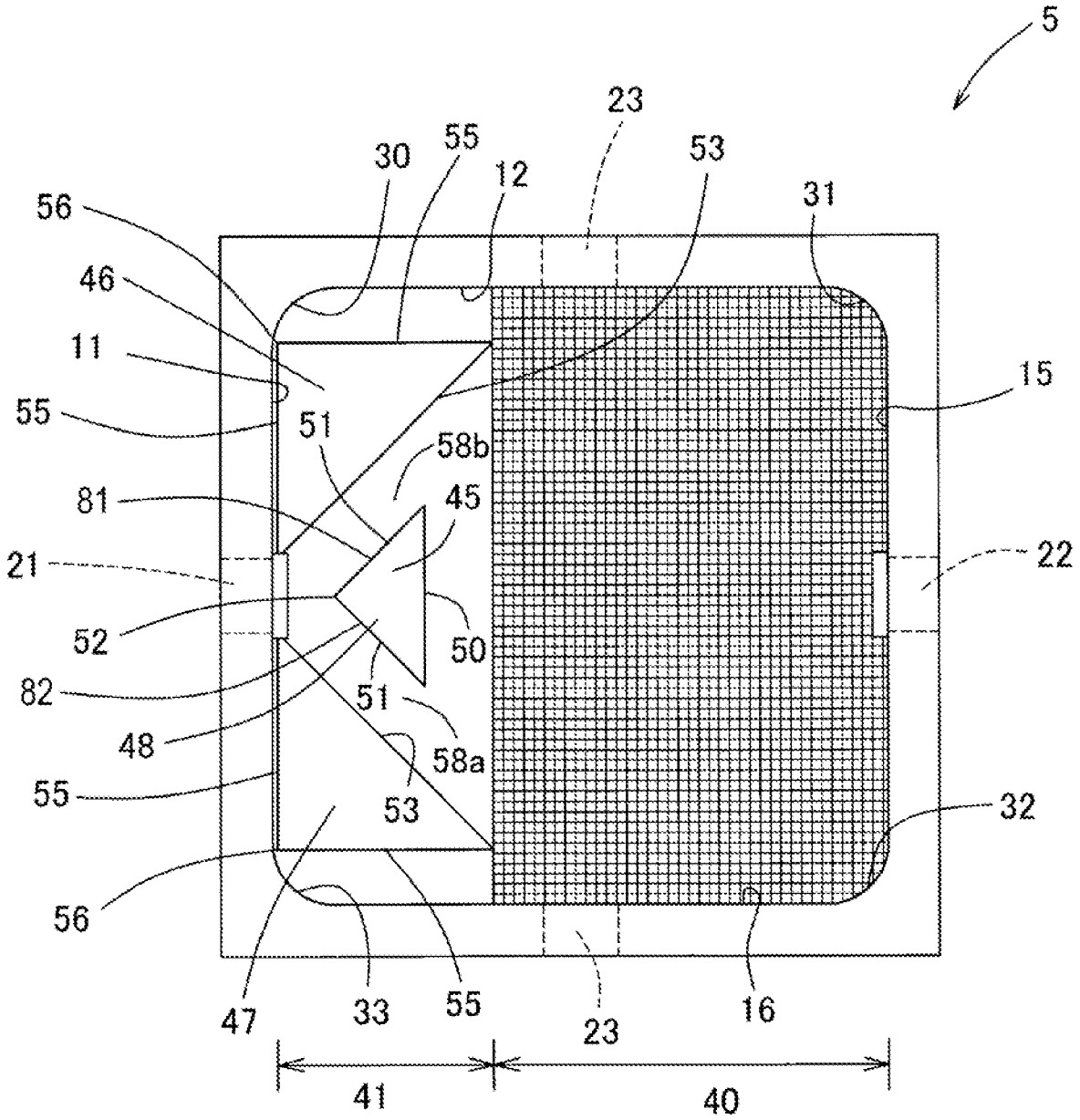
FIG. 4 is a plan view of the main body part of the temperature chamber in FIG. 2.

The main wind orienting member 45 is installed at a position facing the air supply port 21 of the air supply wall 11, as shown in FIGS. 3 and 4. A posture of the main wind orienting member 45 is such that the right-angled apex angle portion 52 is oriented toward the air supply port 21 and the base 50 is approximately parallel to the air supply wall 11 when seen in a plan view. That is, the side surface 80 of the main wind orienting member 45 faces the exhaust wall 15 in parallel, and the side surfaces (wind guide surfaces) 81 and 82 are oriented toward the side walls 12 and 16.

Sides of the main wind orienting member 45 toward the side walls 12 and 16 function as a second ventilation passage. As described below, since the auxiliary wind orienting members 46 and 47 are arranged on both sides of the main wind orienting member 45, in the present embodiment, gaps (second gaps) between the main wind orienting member 45 and the auxiliary wind orienting members 46 and 47 substantially become second ventilation passages 58*a* and 58*b*.

When the air supply port 21 is seen from the installation region 40 side, the main wind orienting member 45 overlaps with a part about a lower half of the air supply port 21, as shown in FIG. 5. In the left-right direction, a perpendicular line Y-Y passing through a center of the air supply port 21 and a center line of the main wind orienting member 45 substantially coincide with each other. In other words, when the air supply port 21 is seen from the installation region 40 side, a vertical straight line 85 including the apex angle portion 52 of the main wind orienting member 45 overlaps with the perpendicular line Y-Y passing through the center of the air supply port 21.

Paying attention to the height direction, the top surface 48 of the main wind orienting member 45 is located lower than a position of the highest height of the air supply port 21. Specifically, the top surface 48 of the main wind orienting member 45 is located at substantially the same position as the center position of the air supply port 21.

The two auxiliary wind orienting members 46 and 47 are arranged on both sides of the main wind orienting member 45, as shown in FIGS. 3 to 6. A posture of the auxiliary wind orienting members 46 and 47 is such that, when seen in a plan view, one oblique side 55 is close to the air supply wall 11 and the other oblique side 55 faces any one of the side walls 12 and 16 at a distance and substantially in parallel. The bases 53 of the auxiliary wind orienting members 46 and 47 each face the center side of the temperature chamber 2.

That is, one of the side surfaces 91 and 92 of the auxiliary wind orienting members 46 and 47 is close to the air supply wall 11, and the other of the side surfaces 91 and 92 faces any one of the side walls 12 and 16 at a distance and substantially in parallel.

The side surfaces 90 of the two auxiliary wind orienting members 46 and 47 each face the center side of the temperature chamber 2.

A positional relationship between the main wind orienting member 45 and the auxiliary wind orienting members 46 and 47 will be schematically described. When seen in a plan view, the oblique side 51 of the main wind orienting member 45 and the base 53 of each of the auxiliary wind orienting members 46 and 47 face each other in parallel with an interval therebetween. Between the side surfaces (side surfaces 81 and 82) including the oblique sides 51 of the main wind orienting member 45 and the side surfaces (side surfaces 90) including the bases 53 of the auxiliary wind orienting members 46 and 47, there are second gaps substantially serving as the second ventilation passages 58*a* and 58*b*.

In the installation region 40 in the temperature adjustment space 20, in which the specimen 300 is installed, an installation plate 60 on which the specimen 300 is installed is provided. The installation plate 60 is provided with many ventilation holes 61.

In the present embodiment, the installation plate 60 is supported in a hollow manner by the stepped portion 17, but this configuration is not essential. For example, a leg portion may be provided on the installation plate 60 to support the installation plate 60 in a hollow manner. In addition, the installation plate 60 may be supported in a hollow manner with another member interposed therebetween. The installation plate 60 may be placed directly on the bottom of the temperature adjustment space 20. In addition, the installation plate 60 may be omitted.

The cover body 6 described above is covered on the opening of the main body part 5 and is fixed to the main body part 5 by a temporary fastening element such as a hook (not shown). One of the cover body 6 and the main body part 5 is provided with a packing (not shown), and the cover body 6 is fixed to the main body part 5 in a state of ensuring airtightness.

As described above, the environment forming device 1 of the present embodiment includes the air conditioning portion (gas supply portion) 100, the dry gas supply portion 200, and the temperature chamber 2. The air conditioning portion (gas supply portion) 100 and the air supply port 21 of the temperature chamber 2 are connected by piping through a duct or tube 101, and temperature-adjusted air is supplied into the temperature adjustment space 20 from the air supply port 21. Note that a temperature sensor (not shown) is installed in the temperature adjustment space 20, and a temperature detected by the temperature sensor is fed back to the air conditioning portion (gas supply portion) 100, so that the temperature of the air supplied into the temperature adjustment space 20 is controlled. The location of the temperature sensor is not limited and may be provided in the air conditioning portion (gas supply portion) 100 or the duct or tube 101.

The dry gas supply portion 200 and the hole 13*a* of the cover body 6 are connected by piping through a hose or tube 202, and dry gas is supplied to the gap 7 between the glass plates 25*a* and 25*b* of the cover body 6.

In addition, the specimen 300 is accommodated in the installation region 40 in the temperature adjustment space 20. Specifically, the specimen 300 is installed on the installation plate 60 installed in the installation region 40.

When it is necessary to energize the specimen 300 or to transmit and receive a signal, a power line or a signal line is passed through the through-hole 23 provided in the side surface of the cover body 6. Furthermore, even in the case where a sensor is attached to the specimen 300, a signal line is passed through the through-hole 23.

As described above, the temperature-adjusted air is supplied into the temperature adjustment space 20 from the air supply port 21, so that the temperature adjustment space 20 is filled with the temperature-adjusted air, and the air is discharged to the outside from the exhaust port 22 provided in the facing exhaust wall 15. That is, the temperature adjustment space 20 becomes a ventilation environment of the temperature-adjusted air, and the specimen 300 is installed in the ventilation environment.

Figure 6:
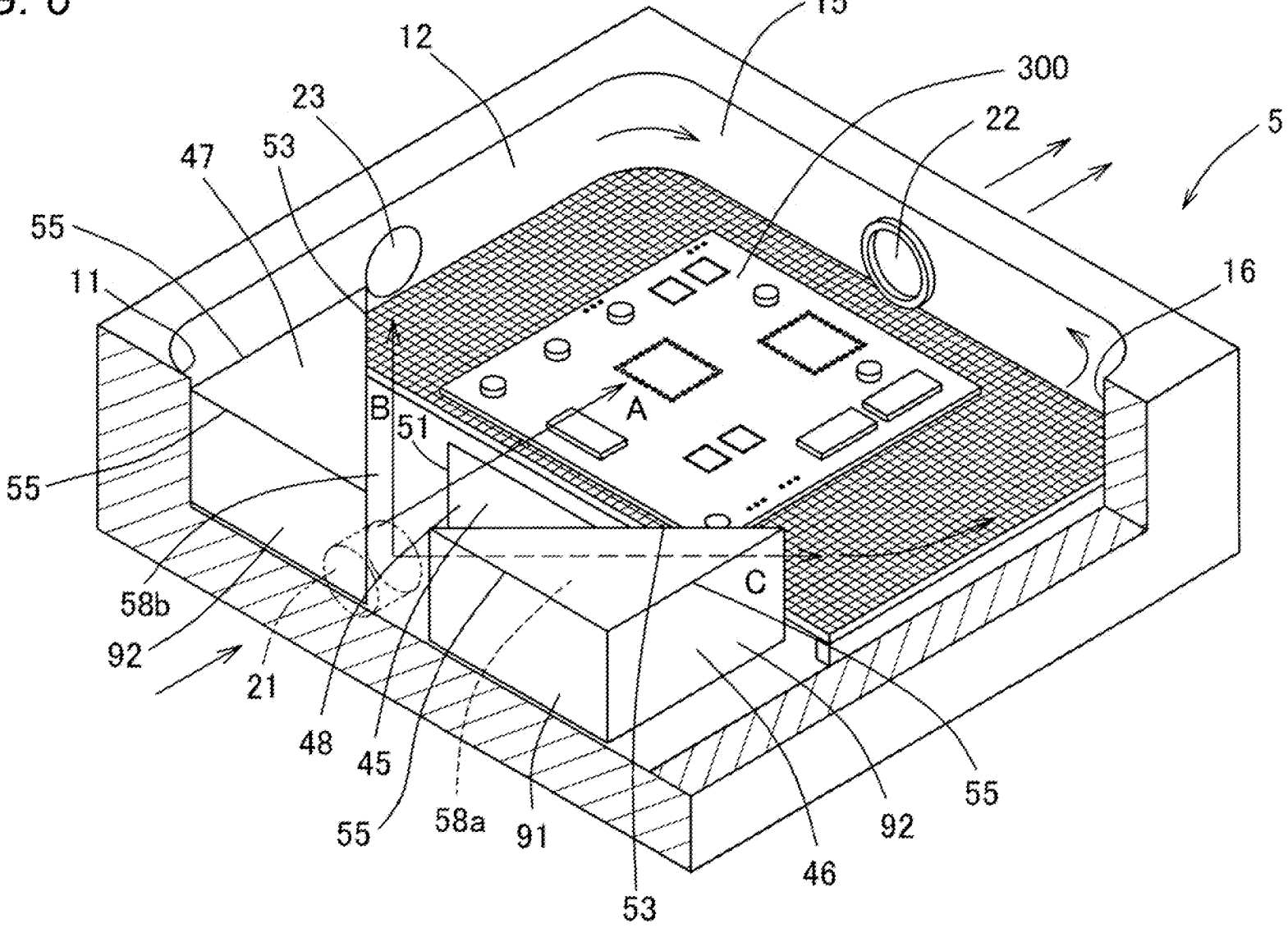
FIG. 6 is a sectional perspective view of the main body part of the temperature chamber in FIG. 2, showing a state in which a specimen is installed.

Next, a passage route of the blowing air in the temperature adjustment space 20 will be described with reference to FIG. 6.

The temperature-adjusted air is supplied into the temperature adjustment space 20 from the air supply port 21. The main wind orienting member 45 is in front of the air supply port 21, and a part of the blowing air collides with the main wind orienting member 45, so that the flow of the blowing air is divided into one mainstream A and two side streams B and C, which finally reach the installation region 40.

That is, the mainstream A is a flow of air that passes through the top surface 48 of the main wind orienting member 45 and directly reaches the installation region 40. The main wind orienting member 45 employed in the present embodiment is located at a position facing the air supply port 21, but the height thereof is low, and when the air supply port 21 is seen from the installation region 40 side, a part of the air supply port 21 is exposed above the main wind orienting member 45. In the present embodiment, a part about the upper half of the air supply port 21 is exposed above the main wind orienting member 45. For this reason, most of the blowing air ejected from the air supply port 21 flows directly into the installation region 40 without colliding with the main wind orienting member 45.

In other words, in the present embodiment, the height ha of the main wind orienting member 45 does not reach the height of the first wall 18, and there is a gap serving as the first ventilation passage 36 between the top surface 48 of the main wind orienting member 45 and the first wall 18. For this reason, most of the blowing air ejected from the air supply port 21 passes through the first ventilation passage 36 and flows directly into the installation region 40. Therefore, most of the blowing air ejected from the air supply port 21 passes over the top surface 48 of the main wind orienting member 45 and flows directly into the installation region 40.

The side streams B and C are flows that pass through the second ventilation passages 58*a* and 58*b*, are directed toward the side walls 12 and 16, and finally reach the installation region 40.

As described above, the main wind orienting member 45 is in front of the air supply port 21, and a part of the blowing air collides with the main wind orienting member 45. Here, the main wind orienting member 45 is triangular in a plan view, and the apex angle portion 52 of the tip faces toward the air supply port 21. That is, the straight line 85, which is a part where the two side surfaces (wind guide surfaces) 81 and 82 are in contact with each other, faces the air supply port 21.

For this reason, a part of the blowing air collides with the part of the apex angle portion 52 (the straight line 85 serving as a part where the side surfaces 81 and 82 are in contact with each other) and changes direction obliquely along the oblique sides 51 continuous with the apex angle portion 52. That is, a part of the blowing air collides with part of the straight line 85 and changes direction obliquely along the side surfaces (wind guide surfaces) 81 and 82.

In this way, the blowing air flows along the wind guide surfaces formed by the side surfaces 81 and 82 of the main wind orienting member 45.

In the temperature chamber 2 of the present embodiment, a part of the blowing air ejected from the air supply port 21 into the temperature adjustment space 20 passes through the main wind orienting member 45 to form the mainstream A, spreads laterally from the air supply port 21, flows directly into the installation region 40 in which the specimen 300 is installed, and covers a surface of the specimen 300.

On the other hand, all or a part of the remainder of the blowing air ejected from the air supply port 21 into the temperature adjustment space 20 is guided to the side surfaces 81 and 82 of the main wind orienting member 45 to form the side streams B and C, and flows toward the side walls 12 and 16 of the installation region 40. For this reason, the environment around the specimen 300 becomes a uniform ventilation environment as a whole, and air is evenly blown to the surface of the specimen 300. Therefore, temperature unevenness is unlikely to occur in the specimen 300.

In addition, in the present embodiment, the auxiliary wind orienting members 46 and 47 are provided on both sides of the main wind orienting member 45, and there are the second gaps substantially forming the second ventilation passages 58*a* and 58*b* between the side surfaces (wind guide surfaces) 81 and 82 hanging down from the oblique sides 51 of the main wind orienting member 45 and the side surfaces 90 hanging down from the bases 53 of the auxiliary wind orienting members 46 and 47. Additionally, the heights (length in the height direction) of the auxiliary wind orienting members 46 and 47 are higher than the height (length in the height direction) of the main wind orienting member 45, and the top surfaces thereof reach positions close to the first wall 18. For this reason, the blowing air does not spread excessively toward the side walls 12 and 16.

The blowing air supplied from the lower half of the air supply port 21 enters the second gaps between the main wind orienting member 45 and the auxiliary wind orienting members 46 and 47, and is directed toward the side walls 12 and 16 without being excessively spread. In this way, a part of the blowing air flows through the second ventilation passages 58*a* and 58*b* and is directed toward the side walls 12 and 16.

Additionally, a part of the blowing air flowing through the second gaps may flow upward. In the present embodiment, the heights of the auxiliary wind orienting members 46 and 47 are higher than the height of the main wind orienting member 45 and are higher than the heights of the second gaps (second ventilation passages 58*a* and 58*b*). For this reason, the blowing air flowing above the second gaps is suppressed from excessively spreading toward the side walls.

Note that the heights of the auxiliary wind orienting members 46 and 47 are considerably high and are even higher than the highest height of the air supply port 21. For this reason, the auxiliary wind orienting members 46 and 47 function as barriers for the blowing air discharged from the air supply port 21, so that it is difficult for the blowing air to flow into the first corner portion 30 and the fourth corner portion 33, and it is difficult for air to stay at the first corner portion 30 and the fourth corner portion 33.

In addition, since the corner portions of the temperature adjustment space 20 employed in the present embodiment are curved surfaces, it is difficult for air to stay at the corner portions, and since the temperature adjustment space 20 becomes a ventilation environment as a whole, temperature unevenness is further unlikely to occur in the specimen 300.

In addition, since the temperature chamber 2 of the present embodiment is provided with the observation window 8 in the cover body 6, the state of the specimen can be visually seen or photographed. Additionally, the glass plates 25*a* and 25*b* are inset to the observation window 8, and dry gas is supplied to the gap 7 between the glass plates. For this reason, the observation window 8 is less prone to condensation and fogging.

In the embodiment described above, the positional relationship between the main wind orienting member 45 and the air supply port 21 is such that the main wind orienting member 45 overlaps with the part about the lower half of the air supply port 21 when the air supply port 21 is seen from the installation region 40 side. However, the degree of overlap should be appropriately adjusted depending on the size of the temperature adjustment space 20, and the like. For this reason, when the air supply port 21 is seen from the installation region 40 side, it may be preferable that the main wind orienting member 45 overlaps with the entire air supply port 21, and in other cases, it may be preferable that the main wind orienting member 45 slightly overlaps with the air supply port.

In addition, regarding the positional relationship between the main wind orienting member 45 and the air supply port 21 in the left-right direction, the centers do not necessarily have to coincide, and the centers may be shifted to left and right.

Figure 9A:
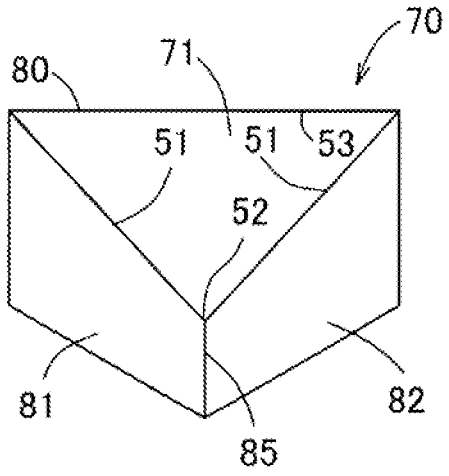
FIG. 9A is a perspective view showing a modified embodiment of the main wind orienting member.
Figure 9B:
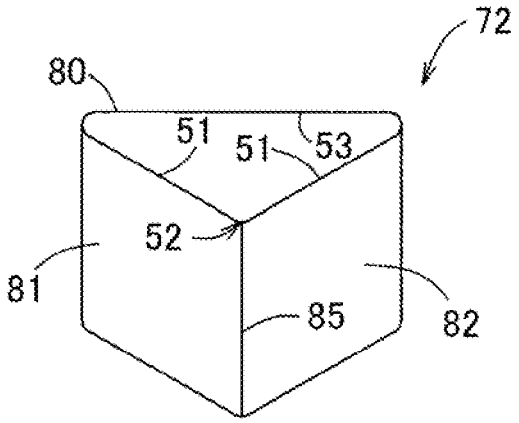
FIG. 9B is a perspective view showing a modified embodiment of the main wind orienting member.
Figure 9C:
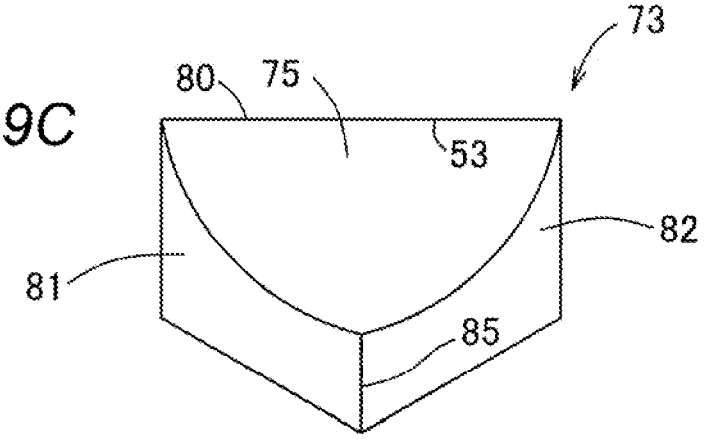
FIG. 9C is a perspective view showing a modified embodiment of the main wind orienting member.

The shape of the main wind orienting member 45 is not limited to the above embodiment. For example, like a main wind orienting member 70 shown in FIG. 9A, a top surface 71 may be inclined. In addition, like a main wind orienting member 72 shown in FIG. 9B, a corner portion may be a curved surface. Like a main wind orienting member 73 shown in FIG. 9C, a top surface 75 may be a curved surface.

Figure 9D:
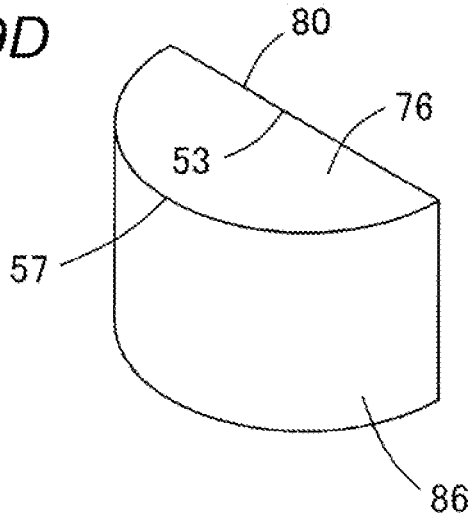
FIG. 9D is a perspective view showing a modified embodiment of the main wind orienting member.

In addition, the planar shape of the main wind orienting member preferably has oblique sides, such as a triangle or a trapezoid, but may be any other shape that can separate the blowing air into left and right. For example, like a main wind orienting member 76 shown in FIG. 9D, the planar shape may be semicircular. In this case, a side surface 86 hanging down from an arc 57 when seen in a plan view becomes the wind guide surface.

The specific description of the relationship between the side surfaces and the like will be omitted by denoting numbers corresponding to the main wind orienting member 45 described above.

The auxiliary wind orienting members 46 and 47 are also the same, and may be partially inclined or curved, or may have a planar shape other than a triangle, such as a semicircle.

The main wind orienting member 45 and the like and the auxiliary wind orienting members 46 and 47 and the like illustrated in the present embodiment are preferably solid blocks, but may also be hollow. In addition, the main wind orienting member 45 and the like and the auxiliary wind orienting members 46 and 47 and the like may be plate-shaped.

When the planar shape of the main wind orienting member or the auxiliary wind orienting member is a triangle, it may not be a right-angled isosceles triangle. The angle of each part is arbitrary.

Figure 12:
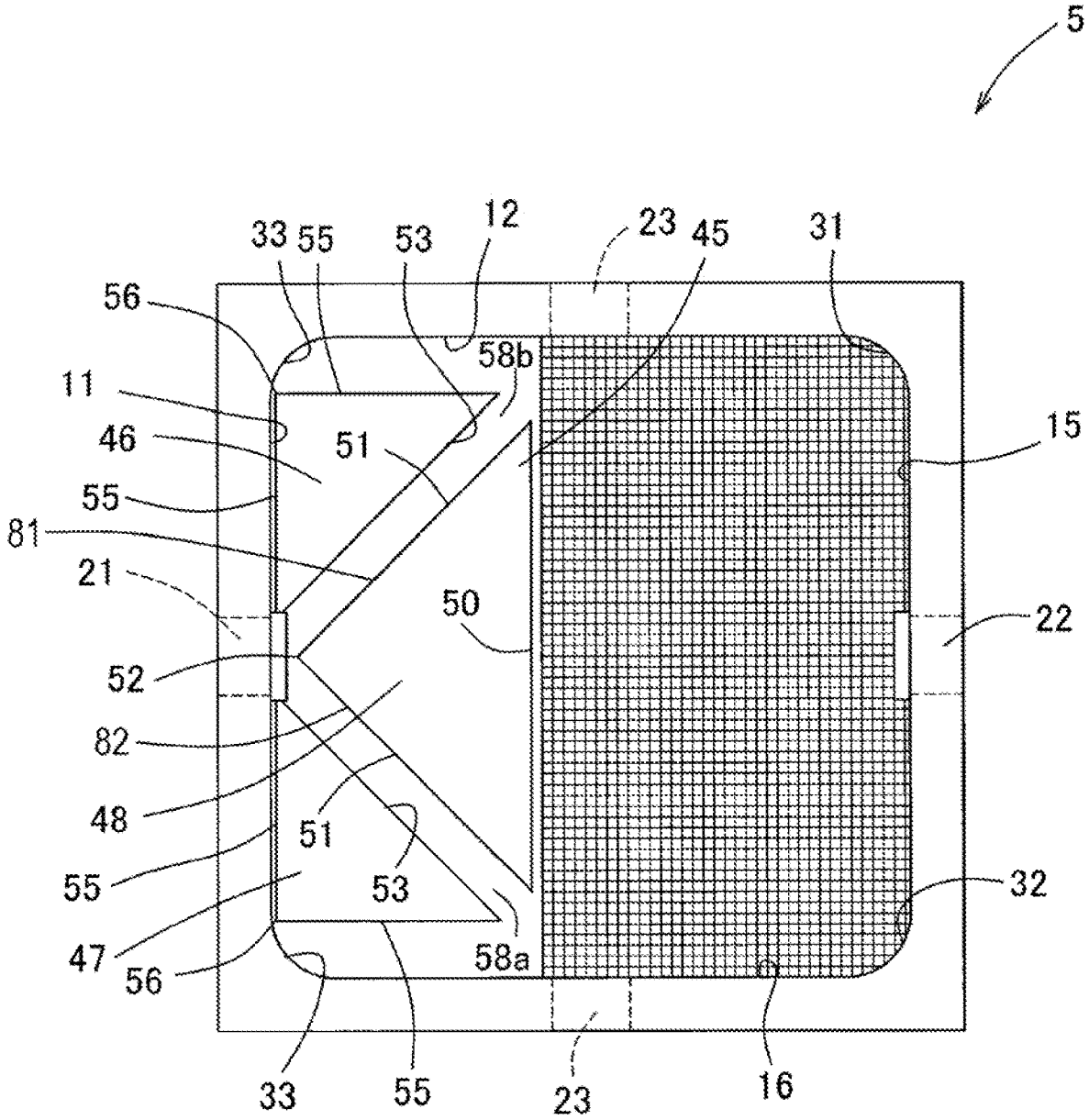
FIG. 12 is a plan view of a main body part of a temperature chamber of another embodiment of the present invention.

In addition, in the above embodiment, the main wind orienting member 45 is smaller than the auxiliary wind orienting members 46 and 47, but the size relationship between both the members is not particularly limited. As shown in FIG. 12, the main wind orienting member 45 may be larger than the auxiliary wind orienting members 46 and 47.

As for the positional relationship between the main wind orienting member 45 and the auxiliary wind orienting members 46 and 47, there is no limitation as to which tip is located on the exhaust port 22 side in the relationship of the direction of air flow from the air supply port 21 to the exhaust port 22, and the tips of both may be flush with each other.

In the present embodiment, some surfaces of the main wind orienting member 45 and some surfaces of the auxiliary wind orienting members 46 and 47 are parallel, but this is not necessarily required. The oblique sides 51 of the main wind orienting member 45 and the bases 53 of the auxiliary wind orienting members 46 and 47 may not be parallel. That is, the intervals of the second gaps may not be constant.

The auxiliary wind orienting members 46 and 47 may be in contact with the side walls 12 and 16.

It is also recommended to prepare members of various sizes and shapes in advance as candidates for the main wind orienting member 45 or the auxiliary wind orienting members 46 and 47, and to replace the main wind orienting member 45 or the auxiliary wind orienting members 46 and 47 according to the shape of the specimen 300 and the like. In addition, the angles of the main wind orienting member 45 and the auxiliary wind orienting members 46 and 47 may be configured so as to be changed arbitrarily.

Figure 10A:
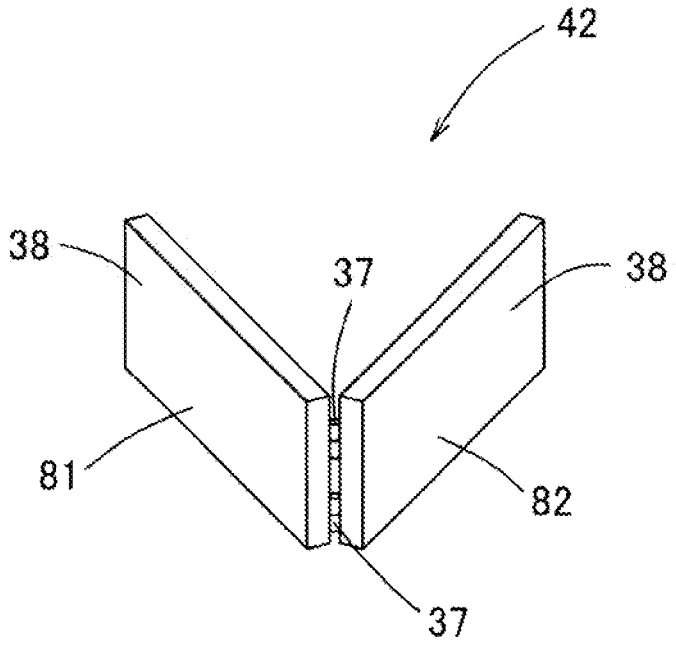
FIG. 10A is a perspective view showing a modified embodiment of the main wind orienting member, showing a state in which an angle between side surfaces is narrowed.
Figure 10B:
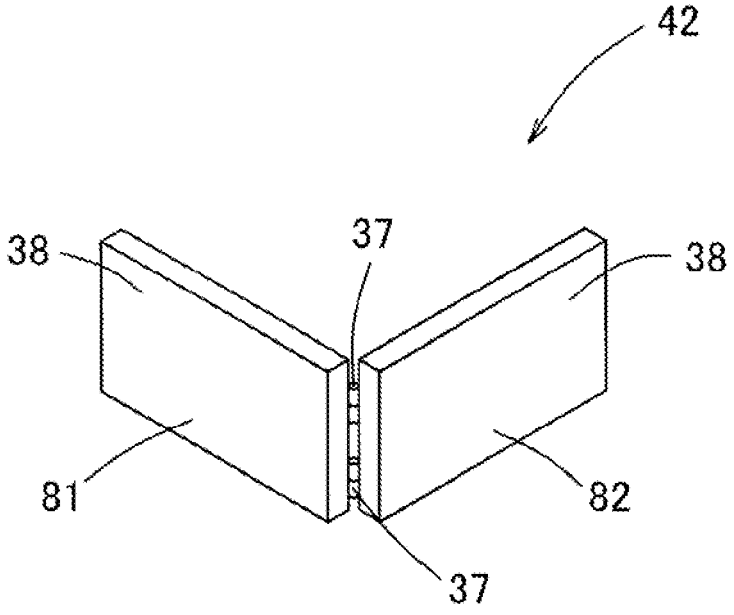
FIG. 10B is a perspective view showing the modified embodiment of the main wind orienting member, showing a state in which the angle between the side surfaces is widened.

For example, as a main wind orienting member 42 shown in FIGS. 10A and 10B, a structure is considered in which two plates 38 are connected by a hinge 37 and an angle between a side surface 81 and a side surface 82 can be arbitrarily changed. Note that a structure similar to FIGS. 10A and 10B can be adopted for the auxiliary wind orienting members.

The two side surfaces may be configured by bending and plastically deforming a single metal plate or resin plate. The angle between the two side surfaces of the main wind orienting member or the auxiliary wind orienting member according to this structure can be arbitrarily changed.

As an example of the main wind orienting member or the auxiliary wind orienting member, a structure whose size can be changed is considered.

Figure 11A:
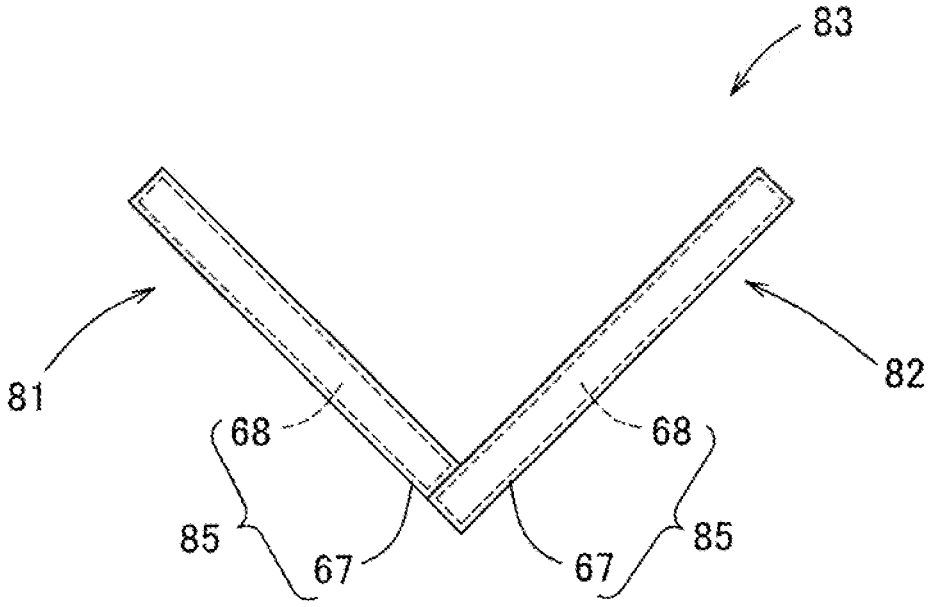
FIG. 11A is a perspective view showing a modified embodiment of the main wind orienting member, showing a state in which the main wind orienting member is made small by shortening side surfaces.
Figure 11B:
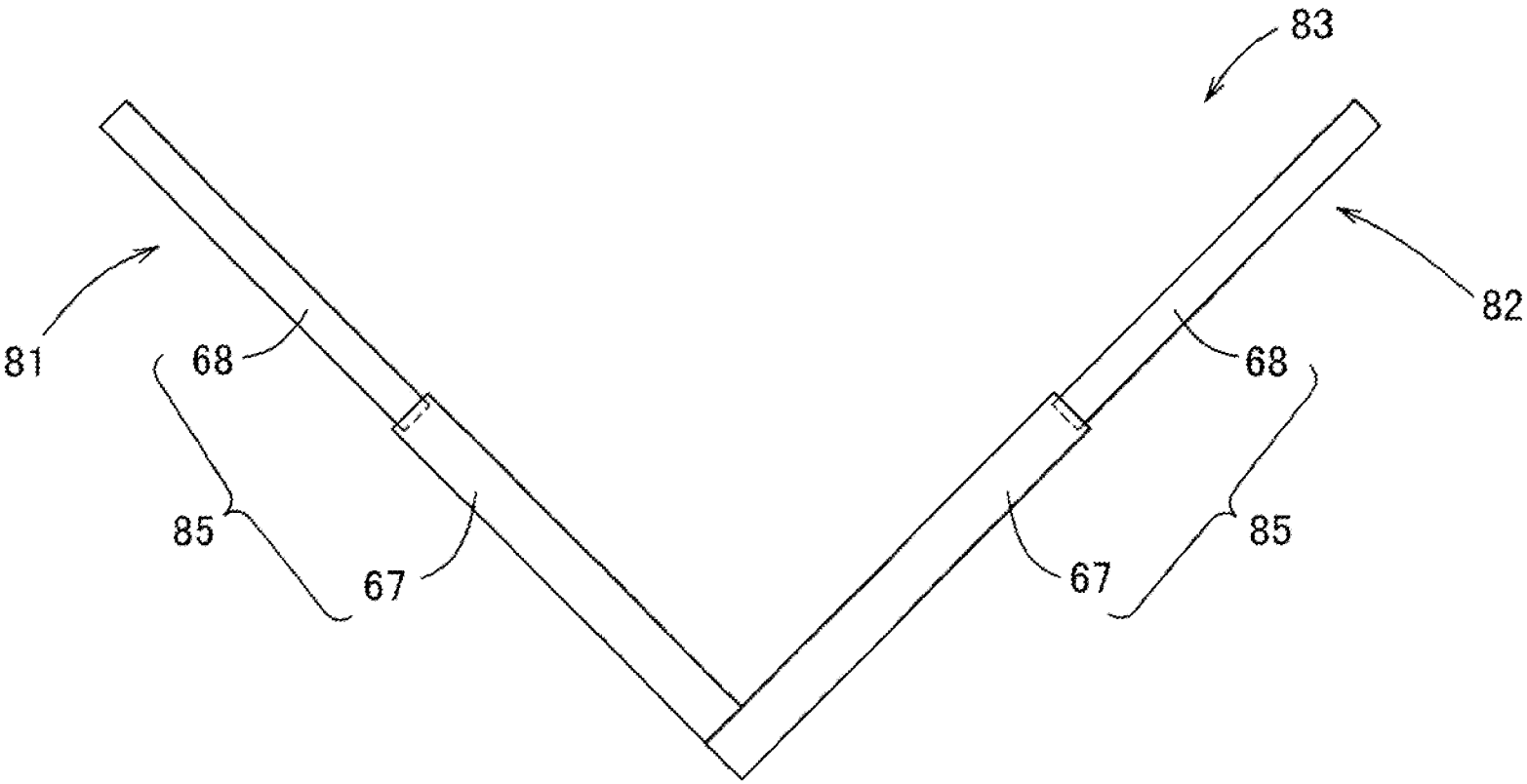
FIG. 11B is a perspective view showing the modified embodiment of the main wind orienting member, showing a state in which the main wind orienting member is made large by widening the side surfaces.

For example, a main wind orienting member 83 shown in FIGS. 11A and 11B includes two plate-shaped members 85 connected at a certain angle. The plate-shaped member 85 is configured by a case member 67 and an intermediate plate member 68.

The case member 67 is hollow and one side surface thereof is open. The intermediate plate member 68 is accommodated in the case member 67 so as to be protrudable and retractable.

As shown in FIG. 11A, in a state in which the intermediate plate member 68 is accommodated in the case member 67, the side surfaces 81 and 82 of the main wind orienting member 83 are small. On the other hand, as shown in FIG. 11B, when the intermediate plate member 68 is pulled out from the case member 67, the side surfaces 81 and 82 of the main wind orienting member 83 are widened. Note that a structure similar to FIGS. 11A and 11B can be adopted for the auxiliary wind orienting members.

In the embodiment described above, the cover body 6 is set as the first wall 18, and the bottom is set as the second wall 10. However, the distinction between the first wall and the second wall is for convenience, and either may be the first wall or the second wall. In addition, in the above embodiment, there is the first gap serving as the first ventilation passage 36 between the first wall 18 and the main wind orienting member 45. However, there may be the first gap serving as the first ventilation passage 36 between each of the first wall 18 and the second wall 10 and the main wind orienting member 45. Additionally, there may be the first gap serving as the first ventilation passage 36 between the second wall 10 and the main wind orienting member 45.

In the embodiment described above, the auxiliary wind orienting members 46 and 47 are provided next to the main wind orienting member 45, and the blowing air is passed through the main wind orienting member 45 and the auxiliary wind orienting members 46 and 47. However, even only with the main wind orienting member 45, the blowing air supplied from the air supply port 21 can be branched into a plurality of flows. Therefore, the auxiliary wind orienting members 46 and 47 are not necessarily required. In the case of a structure without the auxiliary wind orienting members 46 and 47, the spaces between the side surfaces (wind guide surfaces) 81 and 82 of the main wind orienting member 45 and the side walls 12 and 16 of the main body part 5 function as the second ventilation passages.

Figure 13:
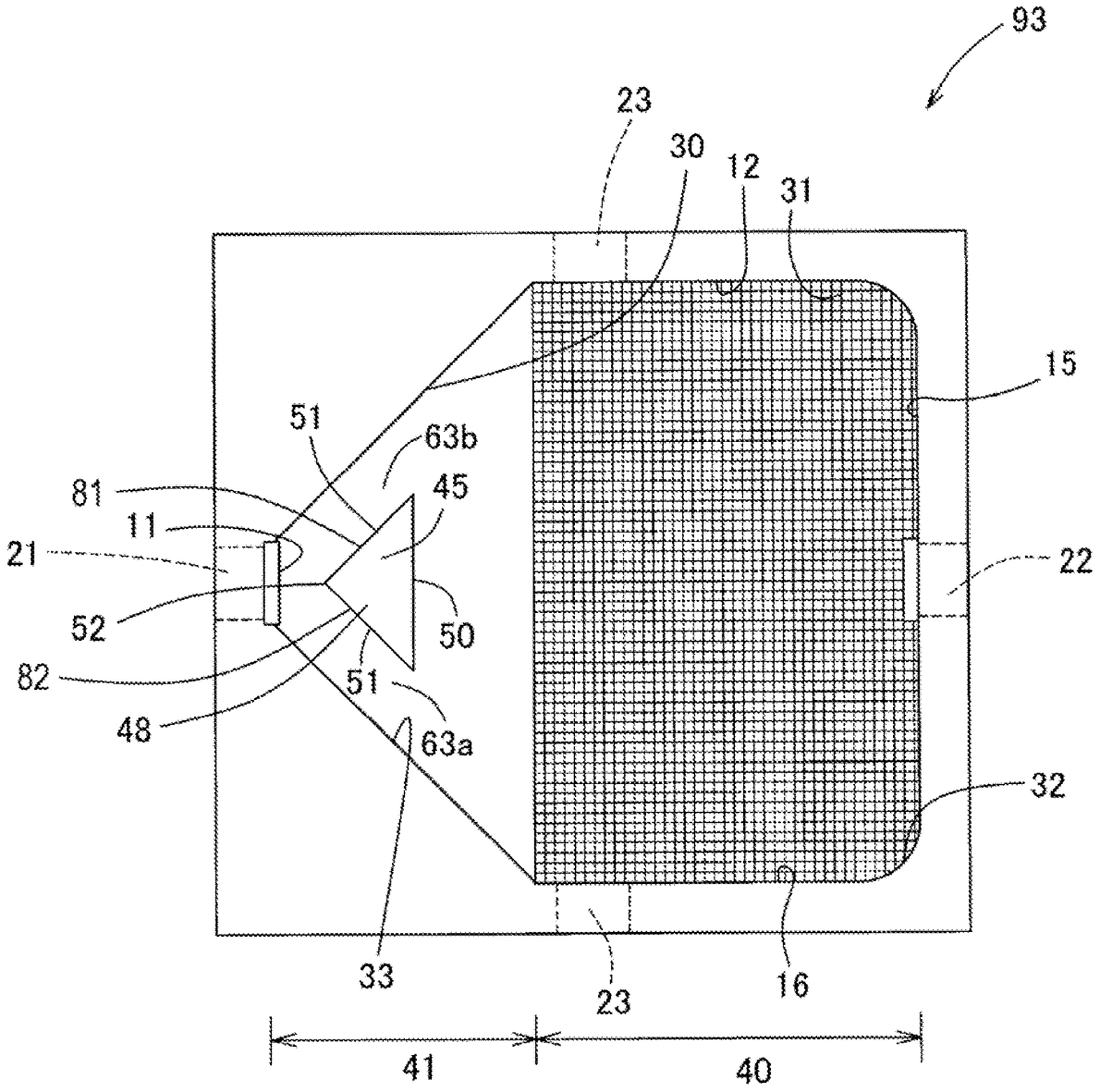
FIG. 13 is a plan view of a main body part of a temperature chamber of still another embodiment of the present invention.

In the embodiment described above, all corner portions of the temperature adjustment space 20 are formed to have an arc shape. However, a similar effect can be expected even if the corner portions are formed to have inclined surfaces instead of the arcs. In addition, instead of all corner portions, only some of the corner portions may be formed to have an arc shape or an inclined surface. For example, the second corner portion 31 or the third corner portion 32 far from the air supply port 21 may be formed to have an arc shape or an inclined shape. Of course, all corner portions may be right angles. For example, like a temperature chamber 93 shown in FIG. 13, the first corner portion 30 or the fourth corner portion 33 may be formed to have large inclinations in order to substitute for the auxiliary wind orienting members. In the present embodiment, the space between the main wind orienting member 45 and the first corner portion 30 and the space between the main wind orienting member 45 and the fourth corner portion 33 are the second gaps and the second ventilation passage 63*a* and 63*b*.

In the embodiment described above, there is no obstacle between the specimen 300 and the exhaust wall 15. However, any obstacle may be present between the specimen 300 and the exhaust wall 15.

Figure 14:
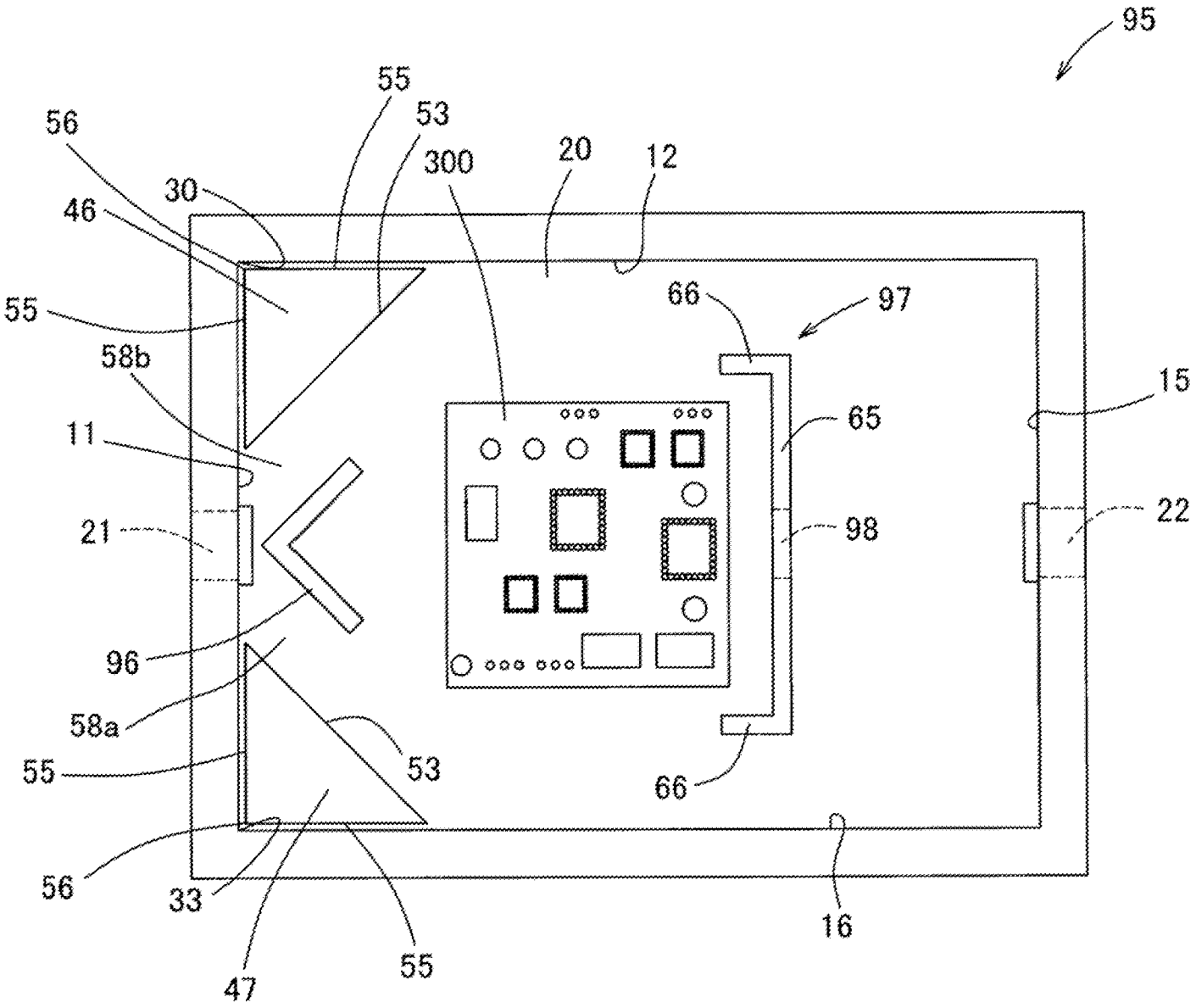
FIG. 14 is a plan view of a main body part of a temperature chamber of yet another embodiment of the present invention.

For example, in a temperature chamber 95 shown in FIG. 14, a wind receiving member 97 is installed at a position closer to the exhaust wall 15 than the center of the temperature adjustment space 20. In the temperature chamber 95, the exhaust wall 15 provided with the exhaust port 22 and the air supply wall 11 face each other. A main wind orienting member 96 employed in the temperature chamber 95 has a plate shape.

The wind receiving member 97 is a concave vertical wall that opens toward the air supply port 21 side, and an opening 98 is provided at a center thereof. The wind receiving member 97 covers the entire specimen 300 on the exhaust wall 15 side and parts of the specimen 300 on the side walls 12 and 16 sides.

It is preferable that the wind receiving member 97 is extendable and contractable depending on the size of the specimen 300. Alternatively, it is preferable that the wind receiving member can be exchanged or reassembled depending on the size of the specimen 300.

The wind receiving member 97 of the present embodiment has a "concave" shape with a main body portion 65 facing the exhaust wall 15 and sleeve portions 66 facing the side walls 12 and 16, but a planar shape thereof may be an arc shape, an "L-shape", or a triangular shape.

In the temperature chamber 95 of the present embodiment, the wind receiving member 97 to which air is blown is provided at a position close to the exhaust wall 15 of the temperature adjustment space 20. For this reason, it is difficult for the blowing air to be exhausted directly through the exhaust port 22. Therefore, even when the specimen 300 is small, temperature unevenness is unlikely to occur in the specimen 300.

The position of the air supply port 21 is not limited to the center of the air supply wall 11, and may be located at an offset position. The exhaust port 22 may be provided in a surface other than the surface facing the air supply port 21.

As described above, an aspect of the present invention is a temperature chamber including: a first wall and a second wall facing each other; a temperature adjustment space surrounded by a plurality of walls connecting the first wall and the second wall; an air supply port and an exhaust port opening to the temperature adjustment space; and an installation region where a specimen is to be installed in the temperature adjustment space. The plurality of walls include an air supply wall formed with the air supply port and a plurality of side walls connected to the air supply wall. A main wind orienting member that overlaps with at least a part of the air supply port when the air supply port is seen from a front, is provided at a position located in the temperature adjustment space and facing the air supply port. A first ventilation passage is provided at, at least one of a position between the main wind orienting member and the first wall and a position between the main wind orienting member and the second wall. A second ventilation passage is provided on a side of the side wall with respect to the main wind orienting member. Apart of blowing air introduced from the air supply port is to pass through the first ventilation passage and to flow into the installation region, and all or a part of the remainder of the blowing air introduced from the air supply port is to be guided to the second ventilation passage by the main wind orienting member and to flow into the installation region.

The temperature chamber of the present aspect has the main wind orienting member provided at a position located in the temperature adjustment space and facing the air supply port. The main wind orienting member overlaps with at least a part of the air supply port when the air supply port is seen from the front. For this reason, at least a part of the blowing air supplied from the air supply port to the temperature adjustment space collides with the main wind orienting member and spreads.

In the temperature chamber of the present aspect, the first ventilation passage is located at, at least one of a position between the main wind orienting member and the first wall and a position between the main wind orienting member and the second wall. For this reason, a part of the blowing air flows into the first ventilation passage. That is, a part of the blowing air passes through the first ventilation passage and flows into the installation region.

In addition, in the temperature chamber of the present aspect, there is the second ventilation passage on the side wall side of the main wind orienting member, and a part of the blowing air goes around the plurality of side walls sides.

The temperature adjustment space of the temperature chamber has the first wall, the second wall, the air supply wall formed with the air supply port, and the plurality of side walls connected to the air supply wall. In the temperature chamber of the present aspect, the blowing air supplied from the air supply port passes through the first ventilation passage and flows into the installation region, and a part of the blowing air flows toward the plurality of side walls via the second ventilation passage.

For this reason, according to the temperature chamber of the present aspect, at least three regions on the central side and peripheral side of the specimen become a ventilation environment. According to the temperature chamber of the present aspect, the specimen is relatively directly affected by heat from the blowing air, so temperature unevenness is unlikely to occur in the specimen.

In the above aspect, the main wind orienting member preferably overlaps with only the part of the air supply port when the air supply port is seen from the front.

In the temperature chamber of the present aspect, the main wind orienting member overlaps with only a part of the air supply port when the air supply port is seen from the front. For this reason, a part of the blowing air supplied from the air supply port passes through the main wind orienting member and flows directly into the installation region.

In the above aspect, the main wind orienting member preferably has a wind guide surface configured to guide the blowing air to the second ventilation passage.

In the temperature chamber of the present aspect, the main wind orienting member has the wind guide surface configured to guide the blowing air toward the side wall. For this reason, the blowing air supplied from the air supply port into the temperature adjustment space flows smoothly toward the side wall.

In the above aspect, an auxiliary wind orienting member configured to guide the blowing air toward the side of the side wall is preferably provided in a vicinity of the main wind orienting member.

According to the temperature chamber of the present aspect, the blowing air supplied from the air supply port into the temperature adjustment space can be smoothly supplied to the surrounding of the specimen by the main wind orienting member and the auxiliary wind orienting member.

In the above aspect, the auxiliary wind orienting member is preferably provided on each of both sides of the main wind orienting member.

According to the present aspect, the blowing air supplied from the air supply port into the temperature adjustment space can be smoothly supplied to the surrounding of the specimen by the main wind orienting member and the auxiliary wind orienting members on both sides thereof.

In the above aspect, the second ventilation passage is preferably configured at a position between the main wind orienting member and the auxiliary wind orienting member.

According to the present aspect, the blowing air passes through the second ventilation passage formed between the main wind orienting member and the auxiliary wind orienting member, and the blowing air supplied from the air supply port into the temperature adjustment space is smoothly guided to the side wall side.

In the above aspect, a height of the auxiliary wind orienting member is preferably higher than a height of the main wind orienting member.

In the temperature chamber of the present aspect, the height of the auxiliary wind orienting member is higher than the height of the main wind orienting member. For this reason, a part of the auxiliary wind orienting member higher than the main wind orienting member can more smoothly supply the blowing air spread by the main wind orienting member to the surrounding of the specimen.

In the above aspect, an observation window is preferably provided.

Since the temperature chamber of the present aspect has the observation window, the state of the specimen can be visually observed, and changes in the specimen can be photographed and recorded.

In the above aspect, at least one corner portion of the temperature adjustment space is preferably a curved surface or an inclined surface.

Since the corner portion of the temperature chamber of the present aspect is a curved surface or an inclined surface, the blowing air flows smoothly and is difficult to stay thereon.

In an aspect related to an environment forming device, the environment forming device includes any one of the aforementioned temperature chambers and a gas supply portion configured to supply a temperature-adjusted gas. The environment forming device is configured to adjust an environment in the temperature adjustment space by supplying the gas from the gas supply portion to the temperature chamber.

According to the environment forming device of the present aspect, the specimen is relatively directly affected by heat from the blowing air, so temperature unevenness is unlikely to occur in the specimen.

When the temperature chamber or environmental forming device of the present invention is used, temperature unevenness is unlikely to occur in the specimen.

What is claimed is:

1. A temperature chamber comprising:

a first wall and a second wall facing each other;

a temperature adjustment space surrounded by a plurality of walls connecting the first wall and the second wall;

an air supply port and an exhaust port opening to the temperature adjustment space; and an installation region where a specimen is to be installed in the temperature adjustment space, wherein the plurality of walls include an air supply wall formed with the air supply port and a plurality of side walls connected to the air supply wall, wherein a main wind orienting member that overlaps with at least a part of the air supply port when the air supply port is seen from a front, is provided at a position located in the temperature adjustment space and facing the air supply port, wherein a first ventilation passage is provided at, at least one of a position between the main wind orienting member and the first wall and a position between the main wind orienting member and the second wall, wherein a second ventilation passage is provided on a side of the side wall with respect to the main wind orienting member, and wherein a part of blowing air introduced from the air supply port is to pass through the first ventilation passage and to flow into the installation region, and all or a part of the remainder of the blowing air introduced from the air supply port is to be guided to the second ventilation passage by the main wind orienting member and to flow into the installation region.

2. The temperature chamber according to claim 1, wherein the main wind orienting member overlaps with only the part of the air supply port when the air supply port is seen from the front.

3. The temperature chamber according to claim 1, wherein the main wind orienting member has a wind guide surface configured to guide the blowing air to the second ventilation passage.

4. The temperature chamber according to claim 1, wherein an auxiliary wind orienting member configured to guide the blowing air toward the side of the side wall is provided in a vicinity of the main wind orienting member.

5. The temperature chamber according to claim 4, wherein the auxiliary wind orienting member is provided on each of both sides of the main wind orienting member.

6. The temperature chamber according to claim 4, wherein the second ventilation passage is configured at a position between the main wind orienting member and the auxiliary wind orienting member.

7. The temperature chamber according to claim 4, wherein a height of the auxiliary wind orienting member is higher than a height of the main wind orienting member.

8. The temperature chamber according to claim 1, wherein an observation window is provided.

9. The temperature chamber according to claim 1, wherein at least one corner portion of the temperature adjustment space is a curved surface or an inclined surface.

10. An environment forming device comprising:

the temperature chamber according to claim 1; and a gas supply portion configured to supply a temperature-adjusted gas, wherein the environment forming device is configured to adjust an environment in the temperature adjustment space by supplying the gas from the gas supply portion to the temperature chamber.

* * * * *